US005479770A

United States Patent [19]

Bothner et al.

[11] Patent Number: 5,479,770

[45] Date of Patent: Jan. 2, 1996

[54] CLEANING RESERVE SURFACES OF RING-SPINNING OR -TWISTING SPINDLES

[75] Inventors: Jakob Bothner, Göppingen; Friedrich Dinkelmann, Alfdorf, both of Germany

[73] Assignee: Zinser Textilmaschinen GmbH, Ebersbach/Fils, Germany

[21] Appl. No.: 346,676

[22] Filed: Nov. 30, 1994

[30] Foreign Application Priority Data

Dec. 15, 1993 [DE] Germany ..... 43 42 773.1

[51] Int. Cl.[6] ..... D01H 1/38; D01H 9/16

[52] U.S. Cl. ..... 57/303; 57/306; 242/18.0 EW; 242/19

[58] Field of Search ..... 57/299, 303, 304, 57/306; 242/19, 18 PW, 18 EW

[56] References Cited

U.S. PATENT DOCUMENTS

| | | | |
|---|---|---|---|
| 3,263,407 | 8/1966 | Jones | 57/306 |
| 3,312,051 | 4/1967 | Schumann . | |
| 3,631,663 | 2/1972 | Krauss | 57/303 |
| 3,782,094 | 1/1974 | Flowers et al. | 57/306 |
| 4,094,134 | 6/1978 | Kazuo | 57/306 |
| 4,108,388 | 8/1978 | Shar | 242/19 |
| 4,133,168 | 1/1979 | Keller | 57/304 |
| 4,151,706 | 5/1979 | Brooks | 57/299 |
| 4,208,865 | 6/1980 | Koella | 57/303 |
| 4,283,909 | 8/1981 | Keller et al. | 57/306 |
| 5,311,732 | 5/1994 | Friedrich | 57/306 |

FOREIGN PATENT DOCUMENTS

| | | | |
|---|---|---|---|
| 1267154 | 4/1968 | Germany . | |
| 2708553 | 8/1978 | Germany | 57/306 |
| 4021851 | 1/1992 | Germany | 57/304 |
| 4038386 | 6/1992 | Germany . | |
| 4038387 | 6/1992 | Germany | 57/304 |
| 4134217C1 | 9/1992 | Germany . | |
| 91 11 455.1 | 12/1992 | Germany . | |
| 1215526 | 5/1987 | Italy . | |
| 47431 | 3/1984 | Japan | 57/303 |
| 11128 | 3/1985 | Japan | 57/303 |

*Primary Examiner*—William Stryjewski
*Attorney, Agent, or Firm*—Herbert Dubno; Andrew Wilford

[57] ABSTRACT

The instant invention is a reserve-surface cleaner used on a longitudinally extending row of spindles rotatable about respective parallel axes lying in a common longitudinal plane and each having an upper package-forming region, a lower reserve surface, and a contact surface centered on the axis. The cleaning apparatus has a carriage displaceable longitudinally along the row parallel to the plane past the spindles, a blade mounted on the carriage and having an edge juxtaposable with each of the reserve surfaces as the carriage moves along the row, and a spacer mounted on the carriage, fixed thereon relative to the blade, and engageable with the contact surfaces of the spindles as the carriage moves along the row. A spring urges the spacer and blade transversely of the plane toward the spindles so that as the spacer wears a transverse spacing between the blade and the reserve surfaces decreases. A sensor unit detects the transverse spacing between the blade and the reserve surfaces and a controller emits an output when the detected transverse spacing falls below a predetermined threshold.

17 Claims, 4 Drawing Sheets

FIG. 2
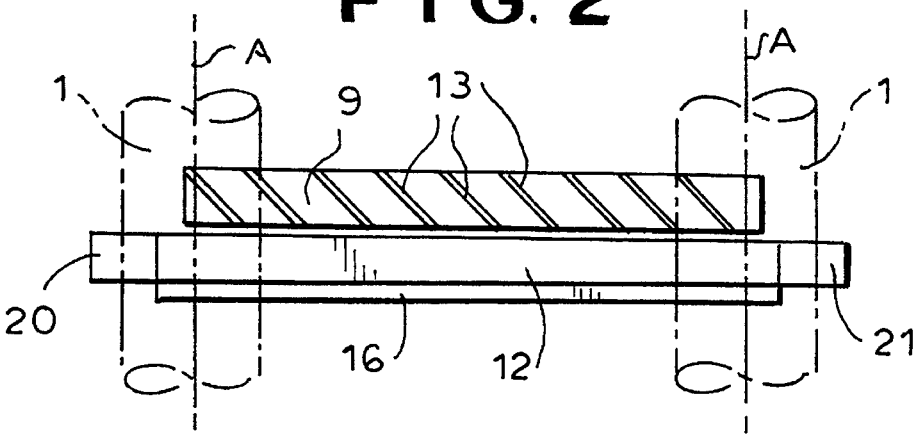
FIG. 3
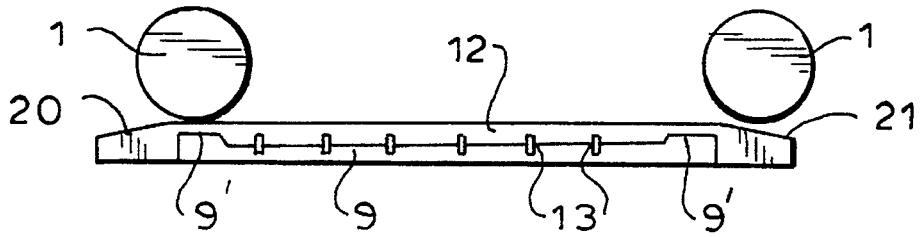
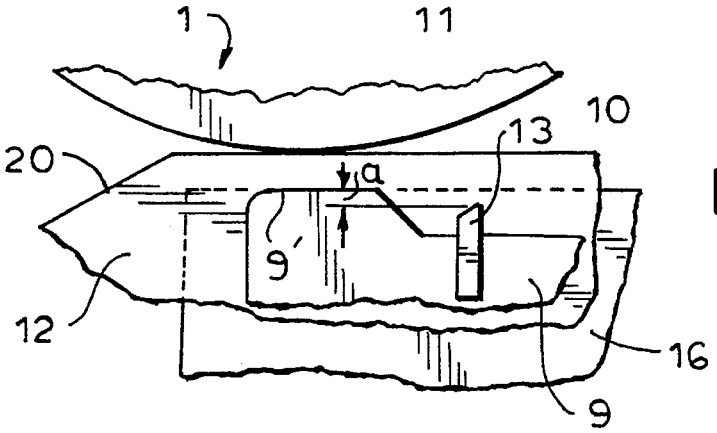
FIG. 4
FIG. 5
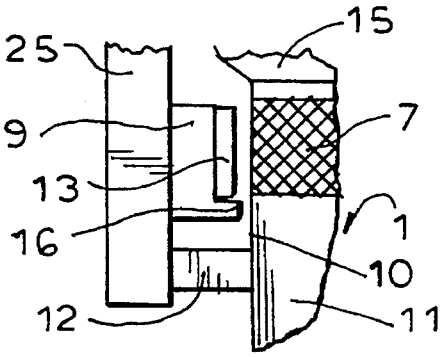
FIG. 6
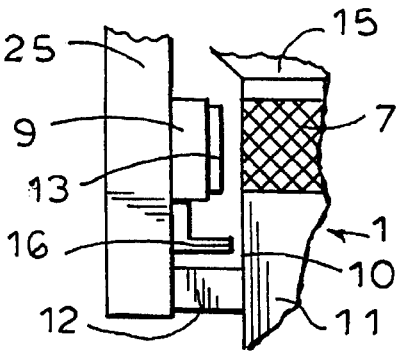

CLEANING RESERVE SURFACES OF RING-SPINNING OR -TWISTING SPINDLES

FIELD OF THE INVENTION

The present invention relates to a ring-spinning or -twisting machine. More particularly this invention concerns an apparatus for cleaning the reserve surface of the spindle of such a machine.

BACKGROUND OF THE INVENTION

The spindles of a ring-spinning or -twisting machine normally have below the upper region on which the yarn or roving is wound a lower so-called reserve region around which the yarn is wound once the yarn package is full. This anchors the yarn to the spindle so the yarn package or cop can be doffed and a new tube can be set on the spindle, whereupon the yarn is wound on it. The yarn on the reserve surface must be removed periodically to prevent it from building up to a point where it interferes with operation of the machine.

The typical apparatus for removing yarn windings in the lower winding region of spindles of a ring-spinning or -twisting machine has a carriage that travels along the machine and has a cutting or scraping element effective on the yarn windings as well as a spacer connected to the cutting element and spring biased against the outer surface of at least one of the spindle whorls.

Such an apparatus is known from Italian patent 1,215,526 filed 28 May 1987 by D. Inverardi which has as cutting element a plurality of brushes which act on the yarn windings. These brushes are only slightly effective at removing yarn windings in the long run in a problem-free manner from the lower winding regions of spindles. They must be replaced often which is expensive and time-consuming.

Another apparatus for removing the lower winding remains from spindles of a ring-spinning machine is known from German utility model 9,111,455.1 wherein use is made of a block traveling along the row of spindles and bearing on the rough lower winding region as well as on a smooth area of the whorl of the spindle. The block is not as hard as the material of the whorl so that it is worn down by the rough lower winding region until its spacing is nearly zero. Thus the block rubs with maximum pressure on the yarn windings, on the lower winding region, grinding them down without actually touching the lower winding region. Such an arrangement subjects the reserve surface to unacceptable wear. The reserve surface has a milled, knurled, or otherwise textured surface that must be preserved so it can catch the yarn. Thus the yarn-removing tool should not directly contact this reserve surface, but instead should come as close to it as safely possible, contacting only the yarn wound on this surface.

In a further device known from German patent document 1,267,154 for removing yarn windings on the spindle whorls use is made of a scraping and vacuuming device that tears off and aspirates the yarn windings. Further known devices (see U.S. Pat. No. 4,094,134) have scratching elements as well as tearing edges (see U.S. Pat. No. 3,312,051).

All these known apparatuses either do not work satisfactorily, are expensive, or have the danger that the element acting on the yarn windings damages the reserve surface.

OBJECTS OF THE INVENTION

It is therefore an object of the present invention to provide an improved apparatus for cleaning the reserve surface of a ring-spinning or -twisting spindle.

Another object is the provision of such an improved apparatus for cleaning the reserve surface of a ring-spinning or -twisting spindle which overcomes the above-given disadvantages, that is which neatly and surely removes yarn windings from the reserve surfaces, but which maintains the removing tool out of direct contact with the reserve surfaces.

SUMMARY OF THE INVENTION

The instant invention is a reserve-surface cleaner used on a longitudinally extending row of spindles rotatable about respective parallel axes lying in a common longitudinal plane and each having an upper package-forming region, a lower reserve surface, and a contact surface centered on the axis. The cleaning apparatus has according to the invention a carriage displaceable longitudinally along the row parallel to the plane past the spindles, a blade mounted on the carriage and having an edge juxtaposable with each of the reserve surfaces as the carriage moves along the row, and a spacer mounted on the carriage, fixed thereon relative to the blade, and engageable with the contact surfaces of the spindles as the carriage moves along the row. A spring urges the spacer and blade transversely of the plane toward the spindles so that as the spacer wears a transverse spacing between the blade and the reserve surfaces decreases. A sensor unit detects the transverse spacing between the blade and the reserve surfaces and a controller emits an output when the detected transverse spacing falls below a predetermined threshold.

Thus with this system when the gap gets too small the output is emitted. This can be a visible or audible alarm, and/or a signal to shut down at least the drive that moves the carriage along the row of spindles. The output is generated before the blade gets close enough to touch the reserve surfaces.

According to another feature of the invention the sensor unit includes a movable contact fixed on the carriage relative to the blade, a fixed contact fixed relative to the plane, and electrical means for generating the output when the two contacts engage each other. A simple contact pin or bolt fixed relative to the spindle plane can be set to engage the contact on the carriage when the spacing gets too small, closing a circuit that trips the controller. The movable contact can be a longitudinally extending rail fixed on the carriage relative to the blade and the fixed contact can be formed by surface portions of the spindles.

The blades according to the invention extend at an acute angle to the axes. More particularly, they are so angled relative to a normal rotation direction of the spindles that yarn fragments cut by the blades from the windings on the reserve surfaces are deflected downward.

In accordance with this invention the spindles are spaced apart in the plane by a predetermined distance and the spacer has a length measured parallel to the plane and perpendicular to the axes that is greater than the predetermined distance so that the spacer engages at least two of the contact surfaces at any time. Each end of the spacer is formed as an angled run-on guide.

The carriage of the instant invention includes a support pivotal about an axis and on which are fixed the blade and the spacer. The blade is between the spacer and the axis. Furthermore a yarn can extend on each of the spindles between the reserve surface and the upper region and the apparatus further has according to the invention a bar fixed on the carriage and provided with a catching hook engageable with the yarn above the reserve surface to cut same as the carriage moves past the respective spindle. Normally the bar has ends each provided with one such catching hook so that it is effective no matter which direction it is moving in. The carriage is provided with a cutting blade adjacent the hook and the hook has a sharpened edge.

The carriage according to this invention includes a support pivotal about an axis and on which are fixed the blade, the bar, and the spacer. This support is a lever pivoted on the carriage. In addition according to this invention the reserve surface is textured and the support surface is smooth, cylindrical, and immediately adjacent the reserve surface and the spacer is a block of insulating material.

BRIEF DESCRIPTION OF THE DRAWING

The above and other objects, features, and advantages will become more readily apparent from the following description, reference being made to the accompanying drawing in which:

FIG. 2 is a front view of a cutting element, spacer, and contact rail of the apparatus according to the invention;

FIG. 3 is a top view of the cutting element and the spacer according to another embodiment of the invention;

FIG. 4 is an enlarged view of a part of the structure of FIG. 3;

FIGS. 5 and 6 are side views of cutting elements, contact rails, and spacers in different embodiments;

SPECIFIC DESCRIPTION

Figure 1:
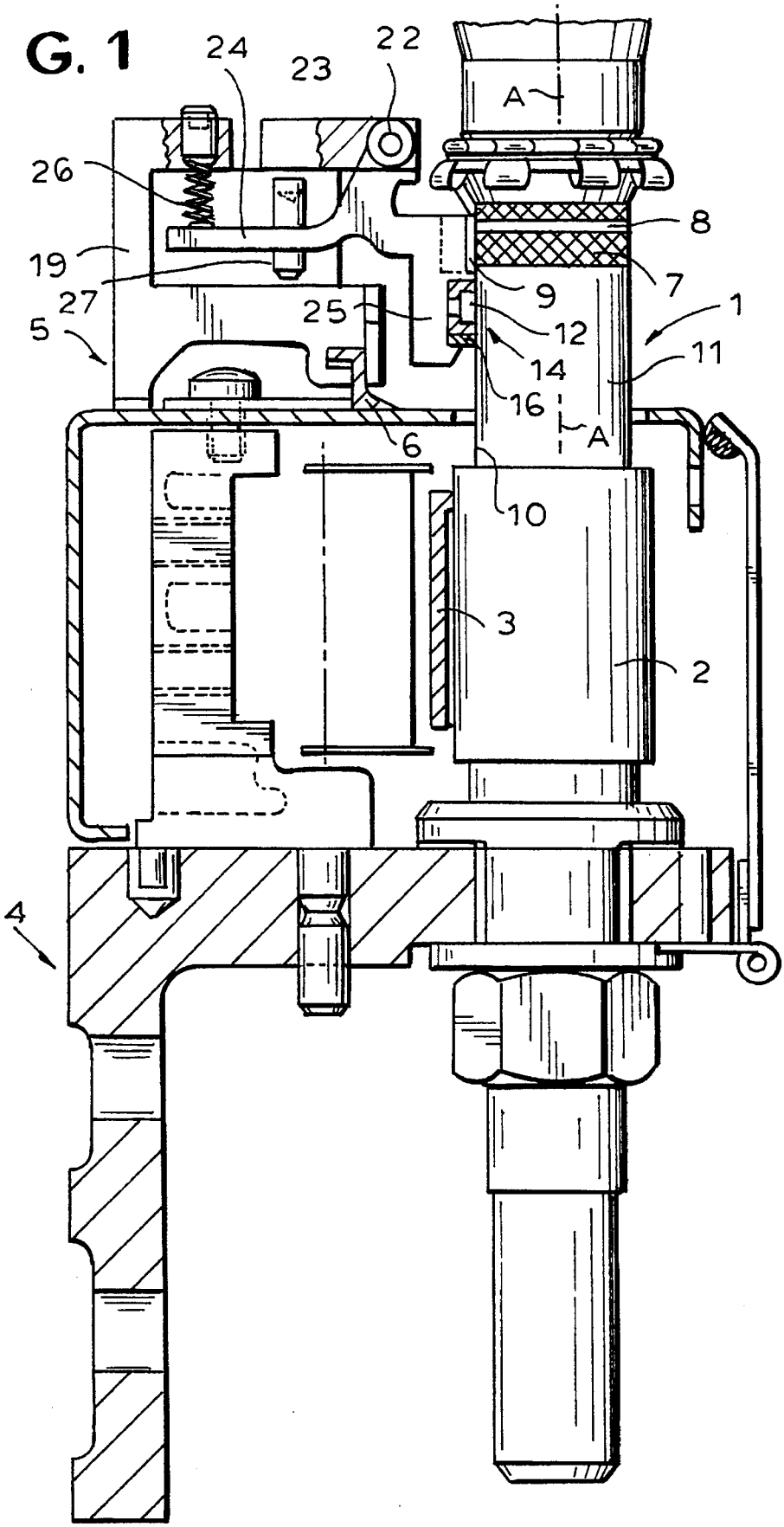
FIG. 1 is a side view of a spindle bank of a ring-spinning or -twisting machine with an apparatus for removing yarn windings in the lower winding region, partly in section.

As seen in FIG. 1 a plurality of spindles 1, of which only one is visible here, are arranged in a row on a ring bank or frame 4 of a ring-spinning or -twisting machine. Each of these spindles 1 has a drive whorl 2 by means of which it is driven by a tangential belt 3 to rotate about an axis A. A cop 15 is set on the spindle 1. A contact surface or region 11 of the spindle 1 between the cop 15 and the drive whorl 2 is below a lower winding or reserve surface 7 on which a yarn winding 8 can be formed. This yarn winding 8 serves to hold the yarn when a full cop is removed so that the spinning process can continue after the cop is changed without interrupting the yarn. Since with each cop change a new yarn winding 8 is formed it is necessary to remove them from time to time from the lower winding surface 7, preferably between cop changes.

This is done by a device 5 which has a carriage 19 that can travel along a housing 4 of the drive device of the spindles 1 and along the row of spindles 1 and which has a cutting element 9 effective on the yarn windings 8.

The cutting element 9 and a spacer 12 and contact rail 16 are mounted on an arm 25 of a two-arm lever 23 which is pivoted on a horizontal axis 22 in the carriage 19. The other arm 24 of the two-arm lever 23 is acted on by a spring 26 of adjustable force so that the cutting element 9, the spacer 12, and the contact rail 16 are spring biased against the surface of the region 11 of the spindle 1. Thus the spacer 12 sets the distance between the cutting element 9 and the region of the spindle 1 carrying the yarn winding 8.

An adjustment bolt 27 in the lever arm 24 serves to limit the pivoting of the two-arm lever 23 toward the spindle 1 so that the cutting element, the spacer 12, and the contact 16 does not swing when the carriage 19 leaves the region of the spindles 1 to a position from which the run-on guides 20, 21 cannot return the spacer 12.

Since the cutting element 9 lies between the pivot 22 of the two-arm lever 23 and the spacer 12, wear of the spacer, which is preferably made of insulating material, is advantageously reduced by the lever ratio in a gap reduction between the cutting element 9 and the lower winding surface 7. Thus the blades 13 will move in less than the spacer 12 as same wears, for instance if spacing between the blades 9 and the pivot is two-thirds of the spacing between the spacer 12 and the pivot 22 and the spacer 12 wears and moves in 1.5mm, the blades 9 will move in 1.0 mm. The spacer 12 is not only made of plastic for insulating purposes but also to avoid damage to the whorl 11 as the result of unlubricated high-speed friction between the spacer 12 and the whorl 11 at high spindle speeds. Typically the spindle 1 is formed of a high-grade steel with a knurled surface at the reserve surface 7 while the spacer 12 is made of a hard polyamide such as nylon. It is important to the invention that the material of the spacer 12 be less wear resistant than the spindles 1 since wear is inevitable where these two parts touch, so that wear is restricted to the easily replaced spacer 12.

FIG. 2 shows how the cutting element 9 has a plurality of cutting blades 13 which are preferably arranged at an angle to the respective spindle axes A. The inclination of the cutting blades 13 is so chosen relative to the preferred spindle rotation direction that yarn bits cut out of the yarn winding 8 are deflected downward.

As seen in FIG. 2 the spacer 12 is below the cutting element 9 and has a length that is greater than the spacing between spindles. At its end it has run-on guides 20 and 21. A contact rail 16 which is part of an electrical monitoring device 14 is mounted underneath the spacer 12.

This monitoring device 14 serves to prevent that the cutting blades 13 of the cutting element 9, as a result of wear of the spacer 12, wear and get so close to the region 11 of the spindle 1 that they touch it. The contact rail 16 can to this end electrically contact the region 11 of the spindle or a test bolt 17 shown better in FIG. 7 and output a signal. This happens when the spacer 11 is so worn that the spacing between the cutting blades 13 of the cutting element 9 and the lower winding surface 7 is less than a dimension of for example between 0.3 mm and 0.1 mm. In this case the spacing between the contact rail 16 and the region 11 of the spindle is reduced in fact to nothing so that there is an electrical contact between these parts.

According to FIGS. 3 and 4 it is possible for the cutting element 9 to have in its end regions projections 9' which form the contact rail. With this when as a result of wear of the spacer 12 the projections 9' touch the outer periphery 10 of the spindle 1 a signal is outputted by the monitoring device 14 with a space a always remaining so that the cutting blades 13 and the lower winding region 11 of the spindle whorl 1 are protected against damage from mechanical contact. The projections 9' of the cutting element 9 also have the advantage of preventing damage of the cutting blades 13 during handling (shipment, mounting, etc.).

According to FIG. 5 the contact rail 16 is part of the cutting element 9 and the spacer 12 is below this unit. According to FIG. 6 the contact rail 16 can be mounted as an independent unit on the lever arm 25 between the cutting element 9 with the cutting blade 13 and the spacer 12.

Figure 7:
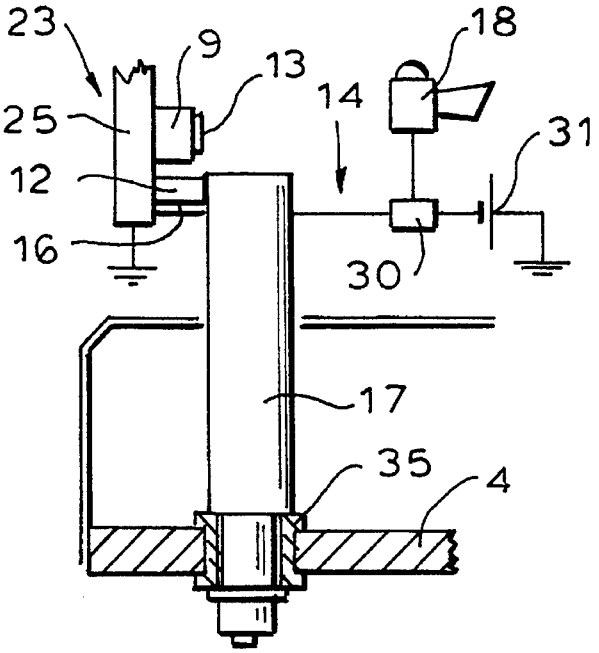
FIGS. 7 and 8 are mainly schematic views of two embodiments of a part of the monitoring device of the apparatus according to the invention.

FIG. 7 shows a possible embodiment of the monitoring device according to the invention with a test bolt 17 which is mounted via insulation 35 on the spindle frame 4. The monitoring device 14 has a relay 30 as well as a current source 31 and a display or alarm 18. If the contact rail 16 touches the test bolt 17 there is an electrical contact between the contact rail 16 and the test bolt 17 so that a signal is outputted by the signalling device 18.

The electrically insulated test bolt 17 is thus electrically energized. The contact rail 16 and one pole of the current source 31 are grounded as shown schematically. It is also possible as not further shown to reverse these parts of the monitoring device, namely by energizing the contact rail and grounding the test bolt.

Instead of the test bolt 17 the last spindle of a row of spindles can serve as a test element in order to activate the monitoring device 14 when the spacer 12 wears and the contact rail 16 touches the spindle 1.

Figure 8:
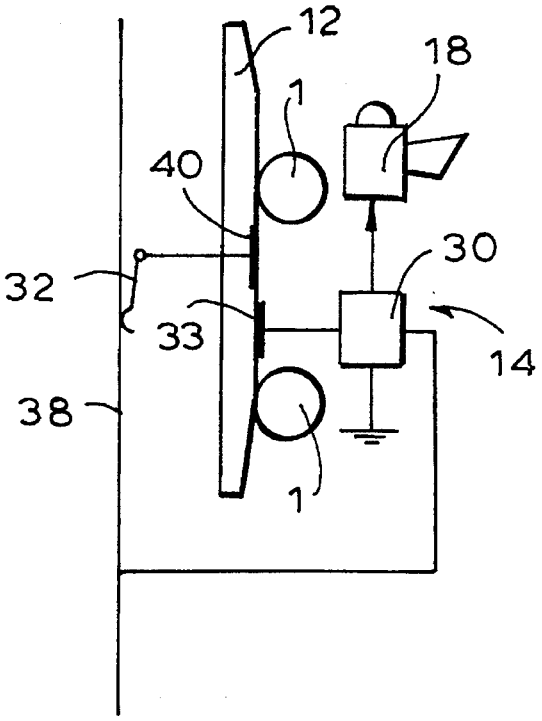

FIG. 8 schematically illustrates a capacitative monitoring device. As visible, set into the spacer 12 is a metal plate 40 which forms a condenser with another fixed metal plate 33. The metal plate 40 in the spacer 12 assumes the function of the contact rail 16. When, as a result of wear of the spacer 12, the metal plate 40 gets so close to the plate 33 that the capacitance of the formed condenser exceeds a predetermined value corresponding to a predetermined spacing the relay 30 outputs a signal to the signaling device 18.

According to FIG. 8 the metal plates 33 and 40 are connected to ground in part through the relay 30. It is also possible for the circuit to be closed via a contact shoe 32 which is connected with the movable metal plate 40 on the carriage 19 and via a commutator rail 38 to the relay 30.

When instead of the metal plates 33 and 40 inductive coils are used the result is a similarly functioning inductive monitoring device.

Figure 12:
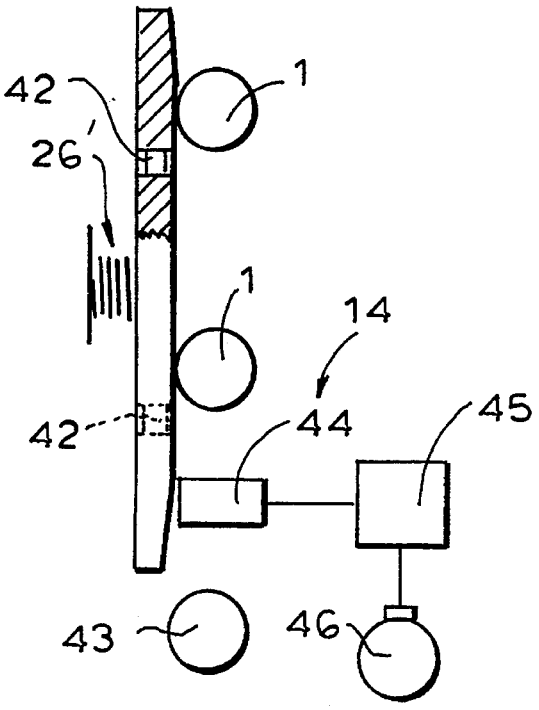
FIG. 12 is a schematic view of a further embodiment of the monitoring device.

A monitoring device using an inductive sensor is shown in FIG. 12. Here two metal bolts 42 are set in the spacer 12 at a predetermined spacing from its front face. Arranged in the path of the carriage 12, preferably between the last spindle 1 of a row of spindles and the support bolt 43, is an inductive sensor 44 which is connected with a control device 45. The spring 26 of FIG. 1 is shown at 26', this spring pushing the spacer 12 and the cutting bar toward the spindle 1.

When the spacing between the metal bolt 42 and the sensor 44 is reduced so much by wear of the spacer 12 that the metal bolt triggers a signal of a predetermined amplitude in the sensor a signaling device such as 18 as described above can be activated by the control device 45. A solution is shown here where a control device 43 for operating the motor 46 driving the carriage 19 is actuated so that it does not start and cannot leave the apparatus 5 parked between the last spindle 1 and the support bolt 43.

Figure 9:
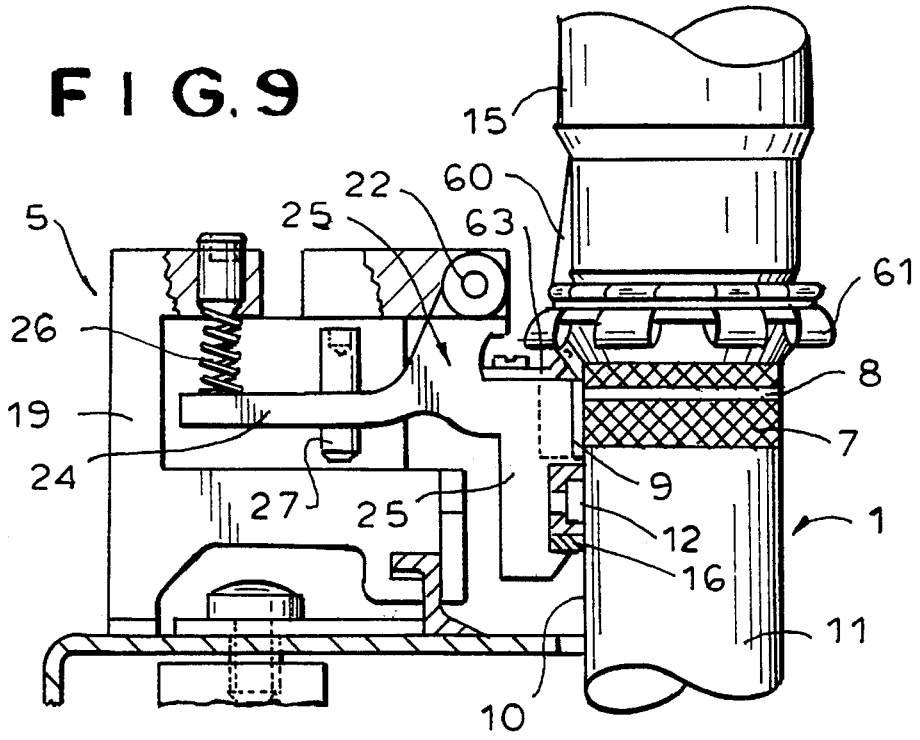
FIG. 9 shows a further embodiment of the invention in side view.
Figure 10:
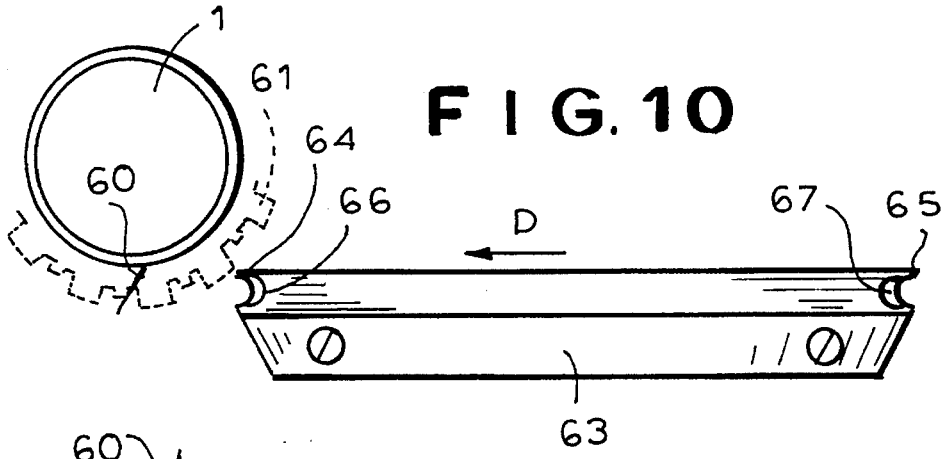
FIG. 10 is a top view of a cutting beam of FIG. 9.
Figure 11:
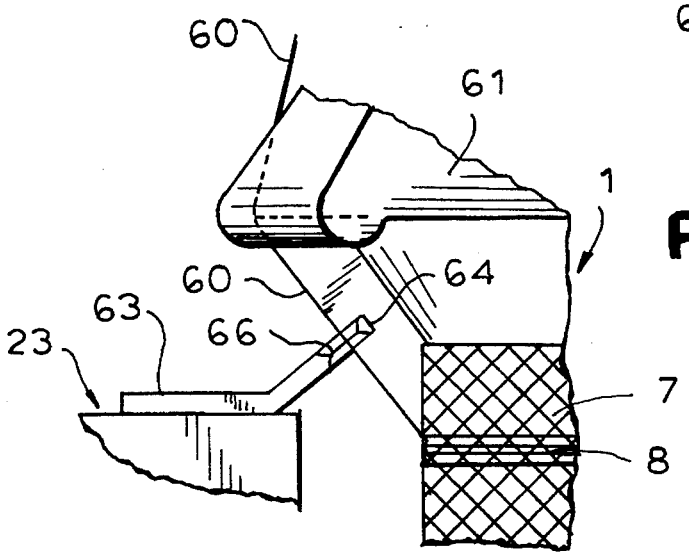
FIG. 11 an enlarged side view of a detail of FIG. 9.

FIGS. 9 through 11 show an advantageous extension of the invention. The spinning yarn 60 can be seen which runs from the cop 15 into the lower winding surface 7 while extending through the yarn groove shown in FIG. 1 of the yarn-catching disk 61 underneath the cop 15 to the yarn windings 8 in the lower winding surface 7.

Above the cutting element 9 is a cutting beam 63 which as seen in FIG. 10 has catching points 64 and 65 on its ends. These points 64, 64 are adjacent cutting edges 66 and 67. As seen in FIGS. 10 and 11 on movement of the device in the direction of arrow D the cutting beam moves behind the spinning yarn in a region above the lower winding surface 7 according to FIG. 9 and engages behind the spinning yarn 60 in this region with the catching point 64 and cuts it by means of the cutting edge 66. To this end the cutting edges 66 and 67 preferably are ground like knives. The cutting beam 63 is effective in both directions of the carriage 5 due to the provision of catching points 64 and 65 and cutting edges 66 and 67 at each end.

FIG. 11 shows in enlarged scale how the spinning yarn 60 is caught and cut in the region below the yarn-catching disk 61 and above the lower winding surface 7 in which it is free but taut by means of the cutting points 64 and 65 and the cutting edges 66 and 67. It is understood that the spinning yarn 60 although not further shown can also be caught and cut by the point 64 or 65 in the region between the yarn-catching disk 61 and the cop 15 in which it is also free and taut.

By means of this additional cutting beam 63 the yarn extending from the cop 15 to the yarn winding 8 can be cut before the cutting edges 13 act on the yarn winding 8. As a result of the two free yarn ends of the yarn winding 8 the effectiveness of the cutting element 9 is substantially increased, the time to remove the yarn winding 8 is shortened, and/or the effectiveness of the removal of the yarn winding is increased.

We claim:

1. In combination with a longitudinally extending row of spindles rotatable about respective parallel axes lying in a common longitudinal plane and each having an upper package-forming region, a lower reserve surface, and a contact surface all having centers of curvature on the axis, an apparatus for cleaning yarn windings from the lower reserve surfaces, the apparatus comprising:

a carriage displaceable longitudinally along the row parallel to the plane past the spindles;

a blade mounted on the carriage and having an edge juxtaposable with each of the reserve surfaces as the carriage moves along the row;

a spacer mounted on the carriage, fixed thereon relative to the blade, and engageable with the contact surfaces of the spindles as the carriage moves along the row;

spring means urging the spacer and blade transversely of the plane toward the spindles, whereby a transverse spacing between the blade and the reserve surfaces decreases as the spacer wears;

sensor means for detecting the transverse spacing between the blade and the reserve surfaces; and control means for emitting an output when the detected transverse spacing falls below a predetermined threshold.

2. The reserve-surface cleaning apparatus defined in claim 1 wherein the sensor means includes a movable contact fixed on the carriage relative to the blade and movable jointly with the blade, a fixed contact fixed relative to the plane, and electrical means for generating the output when the two contacts engage each other.

3. The reserve-surface cleaning apparatus defined in claim 2 wherein the movable contact is a longitudinally extending rail fixed on the carriage relative to the blade and the fixed contact is formed by surface portions of the spindles.

4. The reserve-surface cleaning apparatus defined in claim 1 wherein the blades extend at an acute angle to the axes.

5. The reserve-surface cleaning apparatus defined in claim 4 wherein the blades are so angled relative to a normal rotation direction of the spindles that yarn fragments cut by the blades from the windings on the reserve surfaces are deflected downward.

6. The reserve-surface cleaning apparatus defined in claim 1 wherein the spindles are spaced apart in the plane by a predetermined distance and the spacer has a length measured parallel to the plane and perpendicular to the axes that is greater than the predetermined distance, whereby the spacer engages at least two of the contact surfaces at any time.

7. The reserve-surface cleaning apparatus defined in claim 6 wherein each end of the spacer is formed as an angled run-on guide.

8. The reserve-surface cleaning apparatus defined in claim 1 wherein the carriage includes a support pivotal about an axis spaced from the plane and on which are fixed the blade and the spacer, the blade being between the spacer and the axis.

9. The reserve-surface cleaning apparatus defined in claim 1 wherein a yarn extends on at least one of the spindles between the respective reserve surface and the respective upper region, the apparatus further comprising a bar fixed on the carriage and provided with a catching hook engageable with the yarn above the reserve surface to cut the yarn as the carriage moves past the respective spindle.

10. The reserve-surface cleaning apparatus defined in claim 9 wherein the bar has ends each provided with one such catching hook.

11. The reserve-surface cleaning apparatus defined in claim 10 wherein the carriage includes a support pivotal about an axis and on which are fixed the blade, the bar, and the spacer.

12. The reserve-surface cleaning apparatus defined in claim 11 wherein the support is a lever pivoted on the carriage.

13. The reserve-surface cleaning apparatus defined in claim 9 wherein the carriage is provided with a cutting blade adjacent the hook.

14. The reserve-surface cleaning apparatus defined in claim 13 wherein the hook has a sharpened edge.

15. The reserve-surface cleaning apparatus defined in claim 1 wherein the reserve surface is textured and the contact surface is smooth, cylindrical, and immediately adjacent the reserve surface.

16. The reserve-surface cleaning apparatus defined in claim 1 wherein the spacer is a block of insulating material.

17. The reserve-surface cleaning apparatus defined in claim 1 where the spacer and contact surfaces are formed of different materials, the material of the spacer being substantially more prone to wear on contact with the material of the contact surface than this latter material.

* * * * *